US009945053B2

(12) United States Patent
Yano et al.

(10) Patent No.: US 9,945,053 B2
(45) Date of Patent: Apr. 17, 2018

(54) YARN MANUFACTURING APPARATUS

(71) Applicant: MURATA MACHINERY, LTD., Kyoto-shi, Kyoto (JP)

(72) Inventors: Fumiaki Yano, Kyoto (JP); Shuichi Fukuhara, Kyoto (JP); Hiroki Takashima, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 12 days.

(21) Appl. No.: 14/905,208

(22) PCT Filed: Jul. 22, 2013

(86) PCT No.: PCT/JP2013/069813
§ 371 (c)(1),
(2) Date: Jan. 14, 2016

(87) PCT Pub. No.: WO2015/011768
PCT Pub. Date: Jan. 29, 2015

(65) Prior Publication Data

US 2016/0153124 A1 Jun. 2, 2016

(51) Int. Cl.

| | |
|---|---|
| ***D01H 1/11*** | (2006.01) |
| ***D01H 1/115*** | (2006.01) |
| ***D02G 3/16*** | (2006.01) |
| ***D01H 13/02*** | (2006.01) |
| ***D02G 3/22*** | (2006.01) |
| *D01F 9/127* | (2006.01) |

(52) U.S. Cl.
CPC ..... *D01H 1/115* (2013.01); *D01H 13/02* (2013.01); *D02G 3/16* (2013.01); *D02G 3/22* (2013.01); *D01F 9/127* (2013.01); *D10B 2101/122* (2013.01)

(58) Field of Classification Search
CPC . D01H 1/115; D02G 3/16; D02G 3/22; A10B 2101/22
USPC ..... 57/333
See application file for complete search history.

(56) References Cited

U.S. PATENT DOCUMENTS

| | | | | |
|---|---|---|---|---|
| 2,723,215 A | | 11/1955 | Biefeld et al. | |
| 3,831,365 A | * | 8/1974 | Smith | D02G 1/085 57/285 |
| 4,571,932 A | * | 2/1986 | Stahlecker | D01H 4/16 57/335 |
| 4,642,978 A | * | 2/1987 | Noda | D01H 1/115 57/1 R |
| 4,757,678 A | * | 7/1988 | Stahlecker | D01H 4/50 57/263 |
| 6,308,509 B1 | * | 10/2001 | Scardino | A61F 2/28 57/402 |

(Continued)

FOREIGN PATENT DOCUMENTS

| | | |
|---|---|---|
| DE | 38800 C | 9/1886 |
| DE | 104709 C | 10/1898 |

(Continued)

*Primary Examiner* — Shaun R Hurley
*Assistant Examiner* — Bao-Thieu L Nguyen
(74) *Attorney, Agent, or Firm* — Keating & Bennett, LLP

(57) ABSTRACT

A yarn producing apparatus includes front rollers movable while carbon nanotube (CNT) fibers are running and aggregates the CNT fibers. Each of the front rollers includes a groove provided on an outer circumference thereof to aggregate the CNT fibers.

20 Claims, 6 Drawing Sheets

(56) References Cited

U.S. PATENT DOCUMENTS 6,792,744 B2 * 9/2004 Feuerlohn ..... D01H 1/115 57/328
7,552,580 B2 * 6/2009 Xu ..... D01H 1/02 57/282
7,594,382 B2 * 9/2009 Weide ..... D01H 1/115 57/22
8,286,413 B2 * 10/2012 Atkinson ..... D01H 1/00 57/210
8,522,520 B2 * 9/2013 Smit ..... D01D 5/0076 57/1 R
2006/0048355 A1 * 3/2006 Kim ..... D01D 1/06 28/104
2007/0036709 A1 * 2/2007 Lashmore ..... B82Y 30/00 423/447.1
2008/0136551 A1 * 6/2008 Phillips ..... B82Y 10/00 333/32
2008/0170982 A1 * 7/2008 Zhang ..... B82Y 10/00 423/447.3
2010/0330365 A1 * 12/2010 Hassel ..... B82Y 30/00 428/367
2014/0217643 A1 * 8/2014 Nikawa ..... B82Y 30/00 264/299
2015/0240394 A1 * 8/2015 Blankenhorn ..... D01H 1/115 57/333
2016/0138202 A1 * 5/2016 Takashima ..... D01H 1/115 57/328
2016/0153125 A1 * 6/2016 Takashima ..... D02G 3/16 19/150
2016/0160398 A1 * 6/2016 Yano ..... D01H 1/115 57/328
2016/0160401 A1 * 6/2016 Takashima ..... D01H 1/115 57/333
2016/0201229 A1 * 7/2016 Yano ..... D01H 1/115 57/333

FOREIGN PATENT DOCUMENTS

GB 1 032 152 6/1966
JP 2010-116632 A 5/2010

* cited by examiner

YARN MANUFACTURING APPARATUS

BACKGROUND OF THE INVENTION

1. Field of the Invention

The present invention relates to a yarn producing apparatus for producing carbon nanotube yarn.

2. Description of the Related Art

A known example of a yarn producing apparatus includes a pair of rollers for aggregating carbon nanotube fibers pulled out from a carbon nanotube forming substrate, and twisting means for twisting the carbon nanotube fibers aggregated by the pair of rollers (see, for example, Japanese Patent Application Laid-Open Publication No. 2010-116632).

In the yarn producing apparatus disclosed in Japanese Patent Application Laid-Open Publication No. 2010-116632, the carbon nanotube fibers pulled out from the carbon nanotube-forming substrate are sandwiched and aggregated by a pair of rollers. Fibers of carbon nanotubes have the property of easily aggregating and retain their shape once aggregated. For this reason, with the conventional yarn producing apparatus, the carbon nanotube fibers passed through a pair of rollers are aggregated in the form of a strip (flat shape), and it is difficult to obtain carbon nanotube yarn of a desired shape.

SUMMARY OF THE INVENTION

Preferred embodiments of the present invention provide a yarn producing apparatus that produces carbon nanotube yarn of a desired shape.

A yarn producing apparatus according to an aspect of various preferred embodiments of the present invention produces carbon nanotube yarn from carbon nanotube fibers while causing the carbon nanotube fibers to run. The yarn producing apparatus includes an aggregating unit that is movable with the carbon nanotube fibers running and aggregates the carbon nanotube fibers. The aggregating unit includes a groove provided at a portion thereof to aggregate the carbon nanotube fibers.

In this yarn producing apparatus, a groove is provided at a portion of the aggregating unit to aggregate the carbon nanotube fibers. In the yarn producing apparatus with this configuration, carbon nanotube yarn of a desired shape is obtained by forming the groove into a desired cross-sectional shape of carbon nanotube yarn. Since the aggregating unit is movable while the carbon nanotube fibers are running, the carbon nanotube fibers are able to be aggregated with reduced resistance.

In a preferred embodiment of the present invention, the aggregating unit may include a pair of rollers that rotate about axes in a direction perpendicular or substantially perpendicular to a direction of the carbon nanotube fibers running and arranged to be opposed to each other at a position at which the carbon nanotube fibers are sandwiched. The groove may be provided on an outer circumference of at least one of the pair of rollers and extend in a circumferential direction of the roller. In the yarn producing apparatus with this configuration, the aggregating unit aggregates the carbon nanotube fibers and conveys the carbon nanotube fibers in the running direction. The operation of increasing and reducing the distance between the rollers facilitates passage of the carbon nanotube fibers.

In a preferred embodiment of the present invention, the groove may be provided in each of the pair of rollers and may have an arc-shaped cross section. In this case, the groove may have an approximately semi-circular cross section. With this configuration, the yarn producing apparatus produces carbon nanotube yarn having an approximately circular cross section.

In a preferred embodiment of the present invention, the yarn producing apparatus may further include a support having a supporting surface that supports a carbon nanotube assembly from which the carbon nanotube fibers are drawn. The pair of rollers may rotate about axes in a direction perpendicular or substantially perpendicular to the direction of the carbon nanotube fibers running and perpendicular or substantially perpendicular to the supporting surface of the support. The first touch of carbon nanotube fibers is important because they become aggregated when coming into contact with an object. The carbon nanotube assembly supported on the supporting surface of the support is drawn in the form of a strip along the supporting surface. In the yarn producing apparatus in this configuration, the rollers rotate about the axes in the direction vertical and perpendicular or substantially perpendicular to the supporting surface of the support. In this case, the groove of each roller extends along the surface direction of the supporting surface. With this configuration, the carbon nanotube fibers drawn from the carbon nanotube assembly make a first touch with the grooves and are aggregated by the grooves. The yarn producing apparatus therefore aggregates carbon nanotube fibers excellently and produces more excellent carbon nanotube yarn of a desired shape.

In a preferred embodiment of the present invention, the yarn producing apparatus may further include a second aggregating unit on a downstream side from the aggregating unit in the direction of the carbon nanotube fibers running to further aggregate the carbon nanotube fibers aggregated by the aggregating unit. With this configuration, the yarn producing unit further aggregates the carbon nanotube fibers aggregated by the aggregating unit to produce carbon nanotube yarn.

In a preferred embodiment of the present invention, the second aggregating unit may be any one of a roller including a groove on an outer circumference thereof to aggregate the carbon nanotube fibers, a yarn producing unit that false-twists the carbon nanotube fibers with a swirl flow of compressed air, a narrow tube that aggregates the carbon nanotube fibers while exerting a resistive force on the running carbon nanotube fibers, and a twisting unit that mechanically twists the carbon nanotube fibers.

In a preferred embodiment of the present invention, the second aggregating unit may include a roller having a groove on an outer circumference thereof to aggregate the carbon nanotube fibers. The groove in the second aggregating unit may have a cross-sectional area smaller than the cross-sectional area of the groove provided in the aggregating unit. In the yarn producing apparatus with this configuration, the carbon nanotube fibers aggregated by the groove in the aggregating unit are further aggregated by the groove in the second aggregating unit.

In a preferred embodiment of the present invention, the yarn producing apparatus may further include, in the direction of the carbon nanotube fibers running, a second aggregating unit including any one of a roller including a groove on an outer circumference thereof to aggregate the carbon nanotube fibers, a yarn producing unit that false-twists the carbon nanotube fibers with a swirl flow of compressed air, a narrow tube that aggregates the carbon nanotube fibers while exerting a resistive force on the running carbon nanotube fibers, and a twisting unit that mechanically twists the carbon nanotube fibers. On a downstream side from the second aggregating unit, the aggregating unit may further aggregate the carbon nanotube fibers aggregated by the second aggregating unit. In the yarn producing apparatus with this configuration, the carbon nanotube fibers are further aggregated.

In a preferred embodiment of the present invention, the yarn producing apparatus may further include a second aggregating unit on an upstream side from the aggregating unit in the direction of the carbon nanotube fibers running to aggregate the carbon nanotube fibers. In this case, the second aggregating unit may include any one of a roller having a groove on an outer circumference thereof to aggregate the carbon nanotube fibers, a yarn producing unit that false-twists the carbon nanotube fibers with a swirl flow of compressed air, a narrow tube that aggregates the carbon nanotube fibers while exerting a resistive force on the running carbon nanotube fibers, and a twisting unit that mechanically twists the carbon nanotube fibers. In the yarn producing unit with this configuration, the carbon nanotube fibers is aggregated by the second aggregating unit and the aggregating unit.

Various preferred embodiments of the present invention produce carbon nanotube yarn of a desired shape.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described in details below with reference to the accompanying drawings. It should be noted that the same or corresponding elements are denoted with the same reference signs in the description of the drawings and an overlapping description will be omitted.

Figure 1:
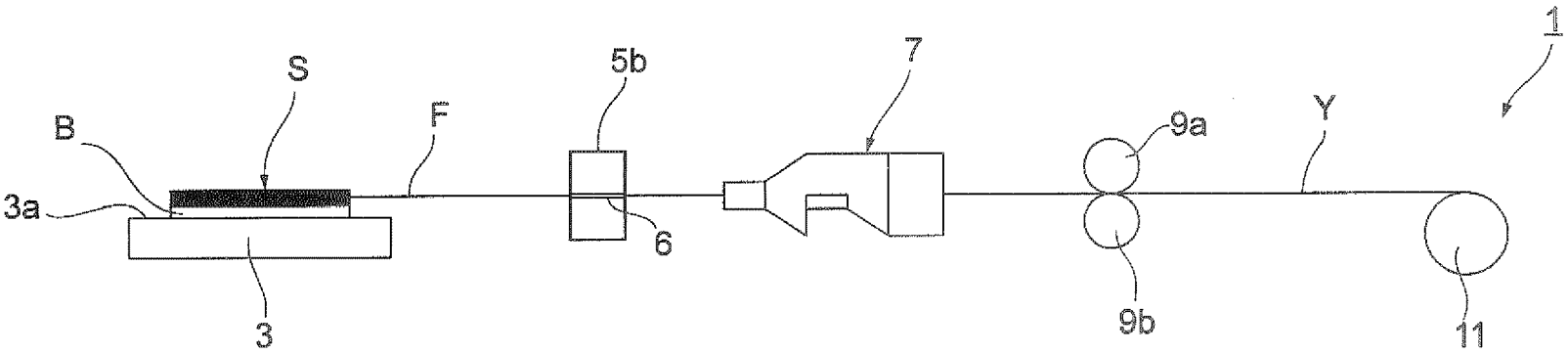
FIG. 1 is a side view of a yarn producing apparatus according to a preferred embodiment of the present invention.
Figure 2:
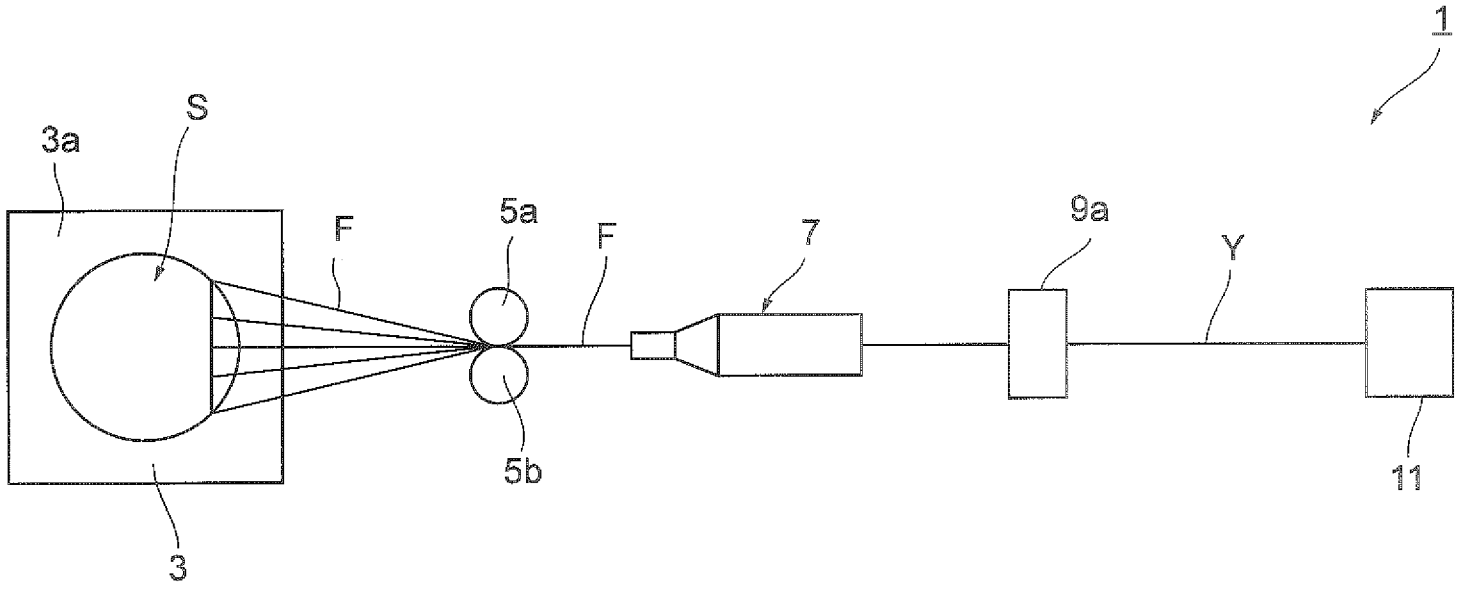
FIG. 2 is a top view of the yarn producing apparatus shown in FIG. 1.

FIG. 1 is a diagram illustrating a yarn producing apparatus according to a first preferred embodiment of the present invention. FIG. 2 is a partial perspective view of the yarn producing apparatus shown in FIG. 1. As shown in the drawings, a yarn producing apparatus 1 is an apparatus that produces carbon nanotube yarn (hereinafter referred to as "CNT yarn") Y from carbon nanotube fibers (hereinafter referred to as "CNT fibers") F while causing the CNT fibers F to run.

The yarn producing apparatus 1 includes a substrate support 3, front rollers (aggregating unit) 5*a*, 5*b*, a yarn producing unit (second aggregating unit) 7, nip rollers (second aggregating unit) 9*a*, 9*b*, and a winding device 11. The substrate support 3, the front rollers 5*a*, 5*b*, the yarn producing unit 7, the nip rollers 9*a*, 9*b*, and the winding device 11 are arranged in this order along a predetermined line. The CNT fibers F run from the substrate support 3 toward the winding device 11. The CNT fibers F are a set of a plurality of fibers of carbon nanotube. The CNT yarn Y is the false-twisted and aggregated CNT fibers F.

The substrate support 3 supports a carbon nanotube-forming substrate (hereinafter referred to as "CNT forming substrate") S from which the CNT fibers F are drawn, in a state of holding the CNT forming substrate S. The CNT forming substrate S is a carbon nanotube assembly called a carbon nanotube forest or a vertically aligned carbon nanotube structure, in which high-density and high-oriented carbon nanotubes (for example, single-wall carbon nanotubes, double-wall carbon nanotubes, or multi-wall carbon nanotubes) are formed on a substrate B by chemical vapor deposition or any other process. Examples of the substrate B include a plastic substrate, a glass substrate, a silicon substrate, and a metal substrate. For example, at the start of production of CNT yarn Y or during replacement of the CNT forming substrates S, a tool called a microdrill can be used to draw the CNT fibers F from the CNT forming substrate S. The substrate support 3 includes a flat loading surface (supporting surface) 3*a* on which the CNT forming substrate S is placed.

Figure 3:
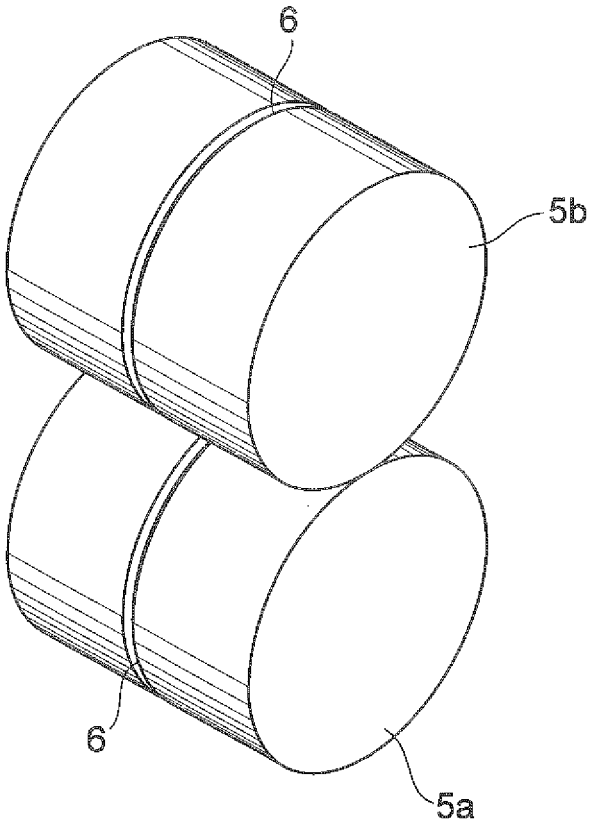
FIG. 3 is a perspective view of front rollers.
Figure 4:
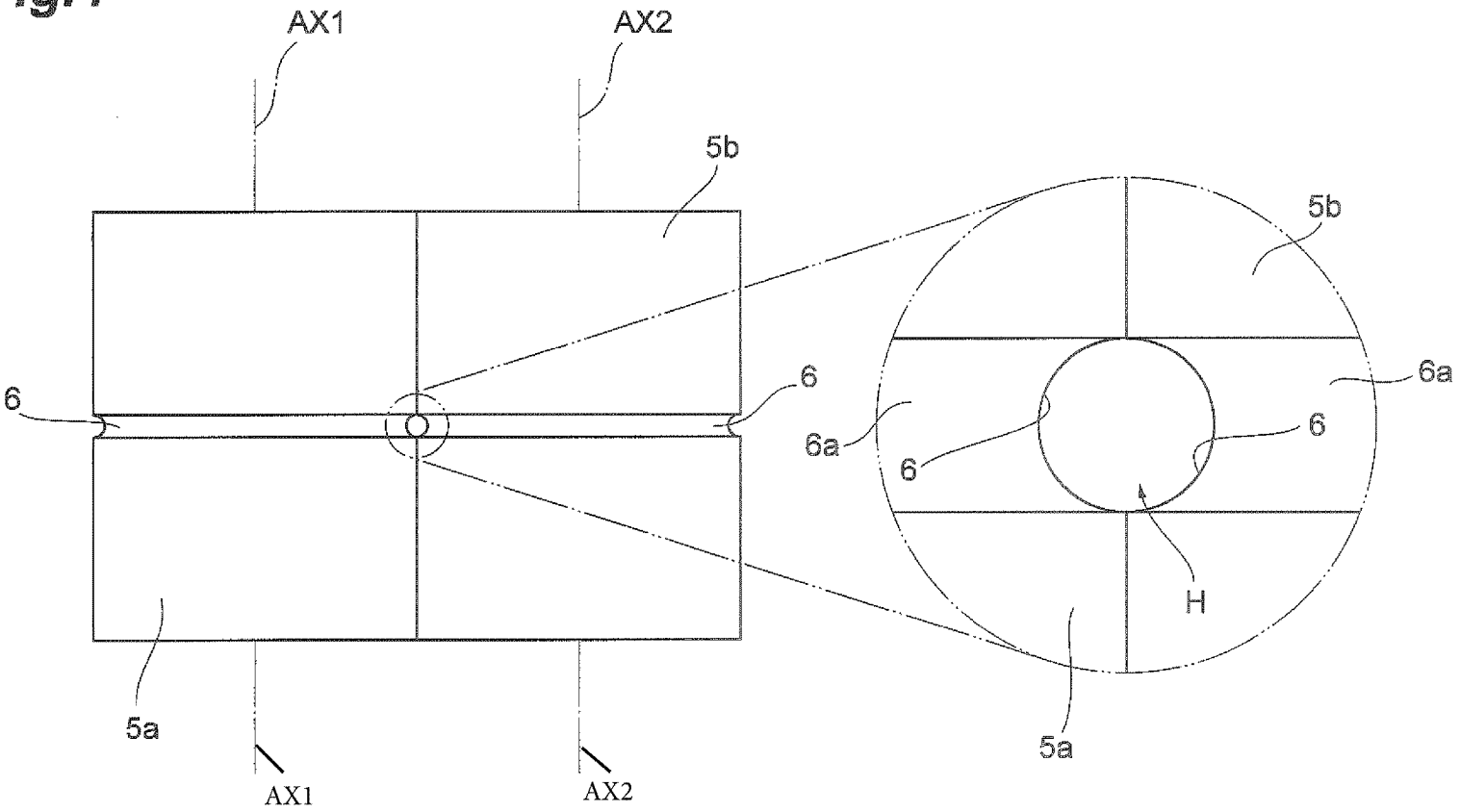
FIG. 4 is a front view of the front rollers shown in FIG. 3.

The front rollers 5*a*, 5*b* aggregate the CNT fibers F drawn from the CNT forming substrate S. FIG. 3 is a perspective view of the front rollers. FIG. 4 is a front view of the front rollers. The front rollers 5*a*, 5*b* each have a cylindrical shape. The front rollers 5*a*, 5*b* are opposed to each other at a position at which the running CNT fibers F are sandwiched. The outer circumferential surface of the front roller 5*a* is in contact with the outer circumferential surface of the front roller 5*b*. The front rollers 5*a*, 5*b* are movable while the CNT fibers F are running. Specifically, the front rollers 5*a*, 5*b* rotate about axes AX1, AX2, respectively, perpendicular or substantially perpendicular to the direction of the CNT fibers F running and vertical to the loading surface 3*a* of the substrate support 3.

In the present preferred embodiment, the front roller 5*a* is driven to rotate by, for example, a not-shown driving source (such as a motor). The front roller 5*b* is driven to rotate by the rotation of the front roller 5*a* in contact therewith. Alternatively, each of the front rollers 5*a*, 5*b* may be driven to rotate by a not-shown driving source. In terms of synchronization of rotation between the front rollers 5*a* and 5*b*, it is preferable that one of the rollers be driven to rotate by the other roller. Alternatively, the front rollers 5*a*, 5*b* may be rotatable without being driven by a driving source. In the present preferred embodiment, the front rollers 5*a*, 5*b* are formed of, for example, resin, metal, or any other material. The materials of the front rollers 5*a*, 5*b* are provided for illustration and are not intended to limit the present invention.

Figure 5:
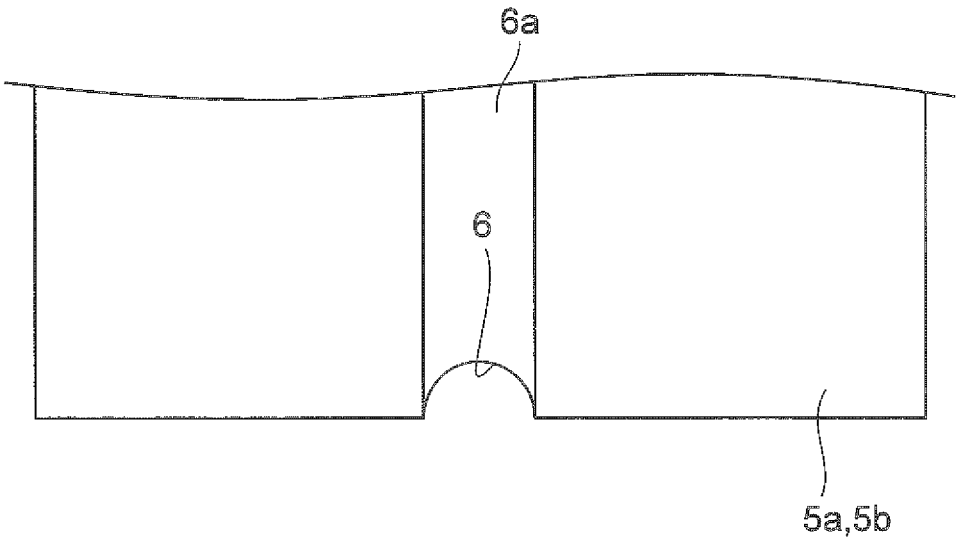
FIG. 5 is a partial enlarged view of the front roller.

Each of the front rollers 5*a*, 5*b* includes a concave groove 6. The groove 6 is circumferentially located all around each of the front rollers 5*a*, 5*b*. The groove 6 is provided at the approximately central portion in the axial direction of each of the front rollers 5*a*, 5*b*. The inner circumferential surface 6*a* of the groove 6 is a surface that conveys the CNT fibers F in the running direction when the front rollers 5*a*, 5*b* are arranged. As shown in FIG. 4 and FIG. 5, in the present preferred embodiment, the groove 6 has a semi-circular (arc-shaped) cross section. That is, as shown in FIG. 4, in a state in which the front rollers 5*a*, 5*b* are arranged, the grooves 6, 6 define an approximately circular space H, as viewed from the front. The CNT fibers F passing through the front rollers 5*a*, 5*b* are thus aggregated into a bundle, for example an approximately circular shape in cross section.

Figure 6:
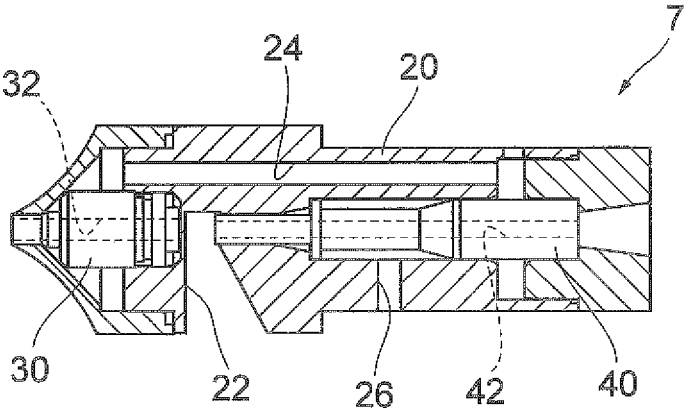
FIG. 6 is a diagram illustrating a yarn producing unit.

The yarn producing unit 7 false-twists the CNT fibers F with a swirl flow of the compressed air (air) to aggregate the CNT fibers F. That is, the yarn producing unit 7 further aggregates the CNT fibers F aggregated by the front rollers 5*a*, 5*b*. FIG. 6 is a diagram illustrating the yarn producing unit. In FIG. 6, a nozzle body 20 is illustrated in cross section. As shown in FIG. 6, the yarn producing unit 7 includes a nozzle body 20, a first nozzle 30, and a second nozzle 40. The first nozzle 30 and the second nozzle 40 are provided in the nozzle body 20. The nozzle body 20, the first nozzle 30, and the second nozzle 40 define a unit.

The nozzle body 20 is a housing that allows the CNT fibers F to pass through and holds the first nozzle 30 and the second nozzle 40 therein. The nozzle body 20 is formed of, for example, brass or any other material. The first nozzle 30 and the second nozzle 40 are arranged in the nozzle body 20.

The first nozzle 30 is provided on one end in the direction of the CNT fibers F running (the position on the upstream side in the direction of the CNT fibers F running, in the yarn producing unit 7 arranged as shown in FIG. 1). The second nozzle 40 is provided on the other end in the direction of the CNT fibers F running (the position on the downstream side from the first nozzle 30, in the yarn producing unit 7 arranged as shown in FIG. 1).

An air escape portion 22 is provided between the first nozzle 30 and the second nozzle 40. The air escape portion 22 lets out a first swirl flow generated in the first nozzle 30 and a second swirl flow generated in the second nozzle 40. The air escape portion 22 is a notch cut in the nozzle body 20. The air escape portion 22 is provided so as to include a path through which the CNT fibers F run. The path of the CNT fibers F between the first nozzle 30 and the second nozzle 40 is in communication with the air escape portion 22 and is partially covered with the nozzle body 20.

The nozzle body 20 includes a first channel 24 and a second channel 26. The first channel 24 is a channel that supplies the compressed air to the first nozzle 30. The second channel 26 is a channel that supplies the compressed air to the second nozzle 40.

The first nozzle 30 generates a first swirl flow to form a balloon in the CNT fibers F and twists the CNT fibers F. The first nozzle 30 is formed of, for example, ceramics. The first nozzle 30 includes a tubular portion 32 that allows the CNT fibers F to pass through and defines a space in which the first swirl flow is generated. The tubular portion 32 is provided in the direction of the CNT fibers F running.

The second nozzle 40 generates a second swirl flow to form a balloon in the CNT fibers F and twists the CNT fibers F. The second nozzle 40 is formed of, for example, ceramics. The second nozzle 40 includes a tubular portion 42 that allows the CNT fibers F to pass through and defines a space in which the second swirl flow is generated. The tubular portion 42 is provided in the direction of the CNT fibers F running.

The nip rollers 9*a*, 9*b* convey the aggregated CNT yarn Y false-twisted by the yarn producing unit 7. A pair of nip rollers 9*a*, 9*b* is opposed to each other at a position at which the running CNT fibers F are sandwiched. The nip rollers 9*a*, 9*b* stop the twisting (balloon) of the CNT fibers F that propagates from the yarn producing unit 7. The nip rollers 9*a*, 9*b* each have a groove (not shown) in the same manner as in the front rollers 5*a*, 5*b*. This groove has the same configuration as the grooves in the front rollers 5*a*, 5*b*. The groove of each of the nip rollers 9*a*, 9*b* is preferably shaped to have a cross-sectional area smaller than the cross-sectional area of the groove 6 of each of the front rollers 5*a*, 5*b*. The CNT fibers F false-twisted by the yarn producing unit 7 are further aggregated by the grooves of the nip rollers 9*a*, 9*b* to yield the CNT yarn Y, which is the final product.

The winding device 11 winds the CNT yarn Y that has been false-twisted by the yarn producing unit 7 and passed through the nip rollers 9*a*, 9*b*, around a bobbin.

The method of producing CNT yarn Y in the yarn producing apparatus 1 will now be described. First, the CNT fibers F drawn from the CNT forming substrate S are aggregated by the grooves 6 of the front rollers 5*a*, 5*b*. The CNT fibers F aggregated by the front rollers 5*a*, 5*b* are then introduced into the yarn producing unit 5 and start being twisted by the second swirl flow in the second nozzle 40 of the yarn producing unit 5. The aggregated CNT fibers F twisted by the second swirl flow are then untwisted by the first swirl flow in the first nozzle 30. By the first swirl flow in the first nozzle 30, a portion (e.g., an outer surface) of the CNT fibers F not aggregated by the second swirl flow is twined around the aggregated surface. The yarn producing unit 5 thus aggregates the CNT fibers F. The CNT fibers F twisted by the yarn producing unit 5 pass through the nip rollers 9*a*, 9*b* and are formed into the CNT yarn Y, which in turn is wound around a bobbin by the winding device 11. The yarn producing apparatus 1 produces the CNT yarn Y, for example, at a rate of a few tens of meters per minute.

As described above, in the yarn producing apparatus 1 according to the present preferred embodiment, the grooves 6 are provided around the outer circumferences of a pair of front rollers 5*a*, 5*b* to aggregate the CNT fibers F. In the yarn producing apparatus 1 with this configuration, the CNT yarn Y of a desired shape is obtained by forming the grooves 6 into a desired cross-sectional shape of the CNT yarn Y. Since the front rollers 5*a*, 5*b* rotate with the CNT fibers F running, the CNT fibers F are aggregated with reduced resistance.

In the present preferred embodiment, the front rollers 5*a*, 5*b* define an aggregating unit. In the yarn producing apparatus 1 with this configuration, the front rollers 5*a*, 5*b* aggregate the CNT fibers F and convey the CNT fibers F in the running direction. The operation of increasing and reducing the distance between the front rollers 5*a* and 5*b* facilitates passage of the CNT fibers F.

The groove 6 provided in each of the front rollers 5*a*, 5*b* has an approximately semi-circular cross section. The yarn producing apparatus 1 according to the present preferred embodiment thus produces CNT yarn Y having an approximately circular cross section.

In the present preferred embodiment, the CNT forming substrate S is placed on the loading surface 3*a* of the substrate support 3, and the CNT fibers F are drawn along the surface direction of the loading surface 3*a*. As shown in FIG. 2, the CNT fibers F are drawn in the form of a strip. The first touch of the CNT fibers F is important because they become aggregated when coming into contact with an object. In the present preferred embodiment, the front rollers 5*a*, 5*b* rotate about the axes in the direction vertical and perpendicular or substantially perpendicular to the loading surface 3*a*. The respective grooves 6 of the front rollers 5*a*, 5*b* extend along the surface direction of the loading surface 3*a*. With this configuration, the CNT fibers F drawn from the CNT forming substrate S make a first touch with the grooves 6 and are aggregated by the grooves 6. That is, the CNT fibers F are aggregated without touching anything but the grooves 6. The yarn producing apparatus 1 therefore aggregates the CNT fibers F excellently and produces more excellent CNT yarn Y of a desired shape.

In the present preferred embodiment, the yarn producing unit 7 is provided on the downstream side from the front rollers 5*a*, 5*b* in the direction of the CNT fibers F running to false-twist the CNT fibers F aggregated by the front rollers 5*a*, 5*b* (for further aggregating the CNT fibers F). With this configuration, the CNT fibers F aggregated into a desired shape by the front rollers 5*a*, 5*b* are false-twisted by a swirl flow. The yarn producing apparatus 1 thus produces CNT yarn Y having a desired shape and further aggregated by false-twisting.

The present invention is not intended to be limited to the foregoing preferred embodiment. For example, in place of the CNT forming substrate S, a floating catalyst apparatus that continuously synthesizes carbon nanotubes to supply the CNT fibers F may be used as the supply source of the CNT fibers F.

In the foregoing preferred embodiment, the front rollers 5*a*, 5*b* have been described as an example of the aggregating unit that aggregates the CNT fibers F drawn from the CNT forming substrate S. However, the front rollers 5*a*, 5*b* are given only for illustration of the aggregating unit and are not intended to limit the present invention. Another example of the aggregating unit may be a belt that includes a groove and is movable in the direction of the CNT fibers F running. Alternatively, rollers may be arranged in a zig-zag pattern.

In the foregoing preferred embodiment, the groove 6 of each of the front rollers 5*a*, 5*b* preferably has a semi-circular shape, for example. However, the shape of the groove is only illustrative and is not intended to limit the present invention. The groove may have any shape that is appropriately adapted to a desired cross-sectional shape of the CNT yarn Y. The shape of the groove may be, for example, triangular.

In the foregoing preferred embodiment, each of the front rollers 5*a*, 5*b* preferably includes the groove 6. However, the groove may be provided in one of the front rollers 5*a*, 5*b*. In this case, the groove is shaped into a desired cross-sectional shape of the CNT yarn Y.

In the foregoing preferred embodiment, the nip rollers 9*a*, 9*b* have grooves. However, this configuration is only illustrative and the nip rollers 9*a*, 9*b* may not have a groove. In the foregoing preferred embodiment, the groove of each of the nip rollers 9*a*, 9*b* preferably has across-sectional area smaller than the cross-sectional area of the groove 6 of each of the front rollers 5*a*, 5*b*. However, this is only illustrative, and the groove of each of the nip rollers 9*a*, 9*b* may have a size equal to the size of the groove 6 of each of the front rollers 5*a*, 5*b*.

In the foregoing preferred embodiment, the yarn producing unit 7 has been described as an example of the second aggregating unit provided on the downstream side from the front rollers 5*a*, 5*b*. Other examples of the second aggregating unit may include a narrow tube that aggregates the CNT fibers F while exerting a resistive force on the running CNT fibers F and a flyer-type twisting unit that mechanically twists the CNT fibers F.

In the foregoing preferred embodiment, the configuration in which the first nozzle 30 and the second nozzle 40 are arranged in the nozzle body 20 has been described, by way of example. However, the first nozzle and the second nozzle may be spaces provided in the nozzle body 20. That is, the configuration equivalent to the first nozzle 30 and the second nozzle 40 may be integrally provided in the nozzle body 20.

In the foregoing preferred embodiment, an additional aggregating unit may be provided on the downstream side from the nip rollers 9*a*, 9*b*.

In the foregoing preferred embodiment, an additional aggregating unit (second aggregating unit) may be provided on the upstream side from the front rollers 5*a*, 5*b* in the direction of the CNT fibers F running. Examples of this additional aggregating unit may include a narrow tube that aggregates the CNT fibers F while exerting a resistive force on the running CNT fibers F and a flyer-type twisting unit that mechanically twists the CNT fibers F.

Various preferred embodiments of the present invention provide a yarn producing apparatus capable of producing carbon nanotube yarn of a desired shape.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A yarn producing apparatus for producing carbon nanotube yarn from carbon nanotube fibers while causing the carbon nanotube fibers to run, the yarn producing apparatus comprising:

an aggregating unit that is movable with the carbon nanotube fibers running and aggregates the carbon nanotube fibers into a bundle; and a support that supports a carbon nanotube assembly from which the carbon nanotube fibers are drawn; wherein the aggregating unit includes a groove provided at a portion thereof to aggregate the carbon nanotube fibers; and the aggregating unit is located such that the carbon nanotube fibers first contact the aggregating unit in a direction of the carbon nanotube fibers running after the carbon nanotube fibers are drawn from the carbon nanotube assembly supported on the support.

2. The yarn producing apparatus according to claim 1, wherein the aggregating unit includes a pair of rollers that rotate about axes in a direction perpendicular or substantially perpendicular to the direction of the carbon nanotube fibers running and opposed to each other at a position at which the carbon nanotube fibers are sandwiched; and the groove is provided on an outer circumference of at least one of the pair of rollers and extends in a circumferential direction of the roller.

3. The yarn producing apparatus according to claim 2, wherein the groove is provided in each of the pair of rollers and has an arc-shaped cross section.

4. The yarn producing apparatus according to claim 3, wherein the groove has an approximately semi-circular cross section.

5. The yarn producing apparatus according to claim 4, wherein the support includes a supporting surface that supports the carbon nanotube assembly from which the carbon nanotube fibers are drawn; and the pair of rollers rotate about axes in a direction perpendicular or substantially perpendicular to the direction of the carbon nanotube fibers running and perpendicular or substantially perpendicular to the supporting surface of the support.

6. The yarn producing apparatus according to claim 5, further comprising a second aggregating unit on a downstream side from the aggregating unit in the direction of the carbon nanotube fibers running to further aggregate the carbon nanotube fibers aggregated by the aggregating unit.

7. The yarn producing apparatus according to claim 6, wherein the second aggregating unit includes any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit that mechanically twists the carbon nanotube fibers.

8. The yarn producing apparatus according to claim 6, wherein the second aggregating unit includes a roller including a groove on an outer circumference thereof to aggregate the carbon nanotube fibers; and the groove in the second aggregating unit has a cross-sectional area smaller than the cross-sectional area of the groove provided in the aggregating unit.

9. The yarn producing apparatus according to claim 1, further comprising, in the direction of the carbon nanotube fibers running, a second aggregating unit including any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit that mechanically twists the carbon nanotube fibers; wherein on a downstream side from the second aggregating unit, the aggregating unit further aggregates the carbon nanotube fibers aggregated by the second aggregating unit.

10. The yarn producing apparatus according to claim 1, further comprising a second aggregating unit on an upstream side from the aggregating unit in the direction of the carbon nanotube fibers running to aggregate the carbon nanotube fibers.

11. The yarn producing apparatus according to claim 10, wherein the second aggregating unit includes any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit that mechanically twists the carbon nanotube fibers.

12. The yarn producing apparatus according to claim 2, wherein the support includes a supporting surface that supports the carbon nanotube assembly from which the carbon nanotube fibers are drawn; and the pair of rollers rotate about axes in a direction perpendicular or substantially perpendicular to the direction of the carbon nanotube fibers running and perpendicular or substantially perpendicular to the supporting surface of the support.

13. The yarn producing apparatus according to claim 12, further comprising a second aggregating unit on a downstream side from the aggregating unit in the direction of the carbon nanotube fibers running to further aggregate the carbon nanotube fibers aggregated by the aggregating unit.

14. The yarn producing apparatus according to claim 13, wherein the second aggregating unit includes any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit that mechanically twists the carbon nanotube fibers.

15. The yarn producing apparatus according to claim 13, wherein the second aggregating unit includes a roller including a groove on an outer circumference thereof to aggregate the carbon nanotube fibers; and the groove in the second aggregating unit has a cross-sectional area smaller than a cross-sectional area of the groove provided in the aggregating unit.

16. The yarn producing apparatus according to claim 2, further comprising, in the direction of the carbon nanotube fibers running, a second aggregating unit including any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit that mechanically twists the carbon nanotube fibers; wherein on a downstream side from the second aggregating unit, the aggregating unit further aggregates the carbon nanotube fibers aggregated by the second aggregating unit.

17. The yarn producing apparatus according to claim 3, wherein the support includes a supporting surface that supports the carbon nanotube assembly from which the carbon nanotube fibers are drawn; and the pair of rollers rotate about axes in a direction perpendicular or substantially perpendicular to the direction of the carbon nanotube fibers running and perpendicular or substantially perpendicular to the supporting surface of the support.

18. The yarn producing apparatus according to claim 17, further comprising a second aggregating unit on a downstream side from the aggregating unit in the direction of the carbon nanotube fibers running to further aggregate the carbon nanotube fibers aggregated by the aggregating unit.

19. The yarn producing apparatus according to claim 18, wherein the second aggregating unit includes any one of:

a roller including a groove on an outer circumference thereof to aggregate the carbon nanotube fibers;

a yarn producing unit that false-twists the carbon nanotube fibers with a swirl flow of compressed air;

a narrow tube that aggregates the carbon nanotube fibers while exerting a resistive force on the running carbon nanotube fibers; and a twisting unit mechanically twists the carbon nanotube fibers.

20. The yarn producing apparatus according to claim 18, wherein the second aggregating unit includes a roller including a groove on an outer circumference thereof to aggregate the carbon nanotube fibers; and the groove in the second aggregating unit has a cross-sectional area smaller than the cross-sectional area of the groove provided in the aggregating unit.

* * * * *